US007111679B2

(12) United States Patent
Lohbeck et al.

(10) Patent No.: US 7,111,679 B2
(45) Date of Patent: Sep. 26, 2006

(54) EXPANDER FOR EXPANDING A TUBULAR ELEMENT

(75) Inventors: Wilhelmus Christianus Maria Lohbeck, Rijswijk (NL); Antonius Leonardus Maria Wubben, Rijswijk (NL)

(73) Assignee: Shell Oil Company, Houston, TX (US)

( * ) Notice: Subject to any disclaimer, the term of this patent is extended or adjusted under 35 U.S.C. 154(b) by 95 days.

(21) Appl. No.: 10/471,778

(22) PCT Filed: Mar. 12, 2002

(86) PCT No.: PCT/EP02/02794

§ 371 (c)(1),
(2), (4) Date: Sep. 12, 2003

(87) PCT Pub. No.: WO02/073000

PCT Pub. Date: Sep. 19, 2002

(65) Prior Publication Data

US 2004/0094312 A1 May 20, 2004

(30) Foreign Application Priority Data

Mar. 13, 2001 (EP) ..... 01302314

(51) Int. Cl.
*E21B 23/02* (2006.01)

(52) U.S. Cl. ..... 166/206; 166/210

(58) Field of Classification Search ..... 166/206, 166/207, 210, 217
See application file for complete search history.

(56) References Cited

U.S. PATENT DOCUMENTS 3,191,677 A 6/1965 Kinley
3,691,624 A * 9/1972 Kinley ..... 29/523
3,746,091 A 7/1973 Owen et al.
5,348,095 A * 9/1994 Worrall et al. ..... 166/380
5,366,012 A * 11/1994 Lohbeck ..... 166/277
6,695,065 B1 * 2/2004 Simpson et al. ..... 166/384

FOREIGN PATENT DOCUMENTS

| | | |
|---|---|---|
| DE | 10028 015 | 1/2001 |
| EP | 0 881 354 | 12/1998 |
| JP | 59197323 | 11/1984 |
| WO | 98/00626 | 1/1998 |

OTHER PUBLICATIONS

International Search Report dated Jul. 31, 2002.
U.S. Appl. No. 10/796,664.
U.S. Appl. No. 10/795,894.
U.S. Appl. No. 10/795,841.
U.S. Appl. No. 10/795,951.
U.S. Appl. No. 10/484,288.
U.S. Appl. No. 10/554,071.

* cited by examiner

*Primary Examiner*—Frank S. Tsay
(74) *Attorney, Agent, or Firm*—Rachael A. Stiegel

(57) ABSTRACT

An expander for radially expanding a tubular element by axial movement of the expander through the tubular element is provided. The expander comprising an expander member having a front part of a first cross-sectional size; a rear part of a second cross-sectional size larger than the first cross-sectional size; and an intermediate part arranged between said front part; and, rear part and having a cross-sectional size varying between said first and second cross-sectional sizes. The expander member is provided with fluid supply means for supplying pressurized fluid to the inner surface of the tubular element at a location opposite the intermediate part when the expander member is arranged in the tubular element.

15 Claims, 3 Drawing Sheets

EXPANDER FOR EXPANDING A TUBULAR ELEMENT

FIELD OF THE INVENTION

The invention relates to an expander for radially expanding a tubular element by axial movement of the expander through the tubular element, and to a method of radially expanding a tubular element.

BACKGROUND OF THE INVENTION

Radial expansion of tubular elements has been applied, for example, in wellbores whereby a tubular casing is lowered into the wellbore in unexpanded state through one or more previously installed casings. After the casing is set at the required depth, an expander is moved through the casing to radially expand the casing to an inner diameter which is about equal to the inner diameter of the previously installed casing(s). In this manner it is achieved that the inner diameters of subsequent casings are about equal as opposed to conventional casing schemes which have stepwise decreasing casing diameters in downward direction.

A problem of expanding such tubular elements is the large force required to move the expander through the tubular element. Furthermore, in case the expander is moved through the tubular by applying fluid pressure at the side of the large diameter part of the expander there is a danger of burst of the tubular element when the high fluid pressure exceeds the burst pressure of the tubular element.

SUMMARY OF THE INVENTION

In accordance with the invention there is provided an expander for radially expanding a tubular element by axial movement of the expander through the tubular element, the expander comprising an expander member having a front part of a first cross-sectional size, a rear part of a second cross-sectional size larger than the first cross-sectional size, and an intermediate part arranged between said front part and rear part and having a cross-sectional size varying between said first and second cross-sectional sizes, wherein the expander member is provided with fluid supply means for supplying pressurised fluid to the inner surface of the tubular element at a location opposite said intermediate part when the expander member is arranged in the tubular element.

The method of the invention comprises:

a) moving an expander in axial direction through the tubular element, the expander including an expander member having a front part of a first cross-sectional size, a rear part of a second cross-sectional size larger than the first cross-sectional size, and an intermediate part arranged between said front part and rear part and having a cross-sectional size varying between said first and second cross-sectional sizes;

b) simultaneously with step a), supplying pressurised fluid to the inner surface of the tubular element at a location opposite said intermediate part.

It is thereby achieved that the contact forces exerted by the expander member to the inner surface of the tubular element are supplemented by fluid pressure acting on said inner surface. As a result the required contact forces necessary to expand the tubular element are lowered compared to the situation whereby the contact forces are not supplemented by fluid pressure, and consequently the forces required to move the expander through the tubular element are also lowered. Furthermore, if the expander is moved through the tubular element by the action of fluid pressure in the tubular element, a lower fluid pressure is required to achieve the required movement.

Suitably the expander member is arranged to be moved through the tubular element by the action of fluid pressure of a body of fluid acting on said rear part of the expander member, and wherein the fluid supply means includes a fluid passage providing fluid communication between said body of fluid and the inner surface of the tubular element at said location. It was found that the required fluid pressure is lower than in a situation whereby the contact force is not supplemented by fluid pressure, despite the smaller effective area on which the fluid pressure acts to move the expander forward.

Suitably the front part of the expander member is provided with sealing means arranged to seal the front part relative to the inner surface of the tubular element.

The sealing means can, for example, be applied in case the expander is moved forward by the action of fluid pressure in the tubular element, and whereby the expander includes different elements movable relative to each other between a retracted position in which said rear part has a cross-sectional size smaller than said second cross-sectional size and an expanded position in which the rear end part has said second cross-sectional size. Such expander is sometimes referred to as an expandable cone. Since the clearances between the different elements allow fluid to flow to the inner surface of the tubular element opposite said intermediate part, no other fluid supply means are then required.

Suitable sealing means are a ceramic seal, a labyrinth seal or a hard metal seal.

The expander member can, optionally, be cone-shaped. Furthermore, the expander member can be provided with rollers arranged to roll along the inner surface of the tubular element during expansion thereof.

Typical applications for tubular elements to be expanded are a wellbore tube, a line pipe and a surface pipe.

DETAILED DESCRIPTION OF THE INVENTION

Figure 1:
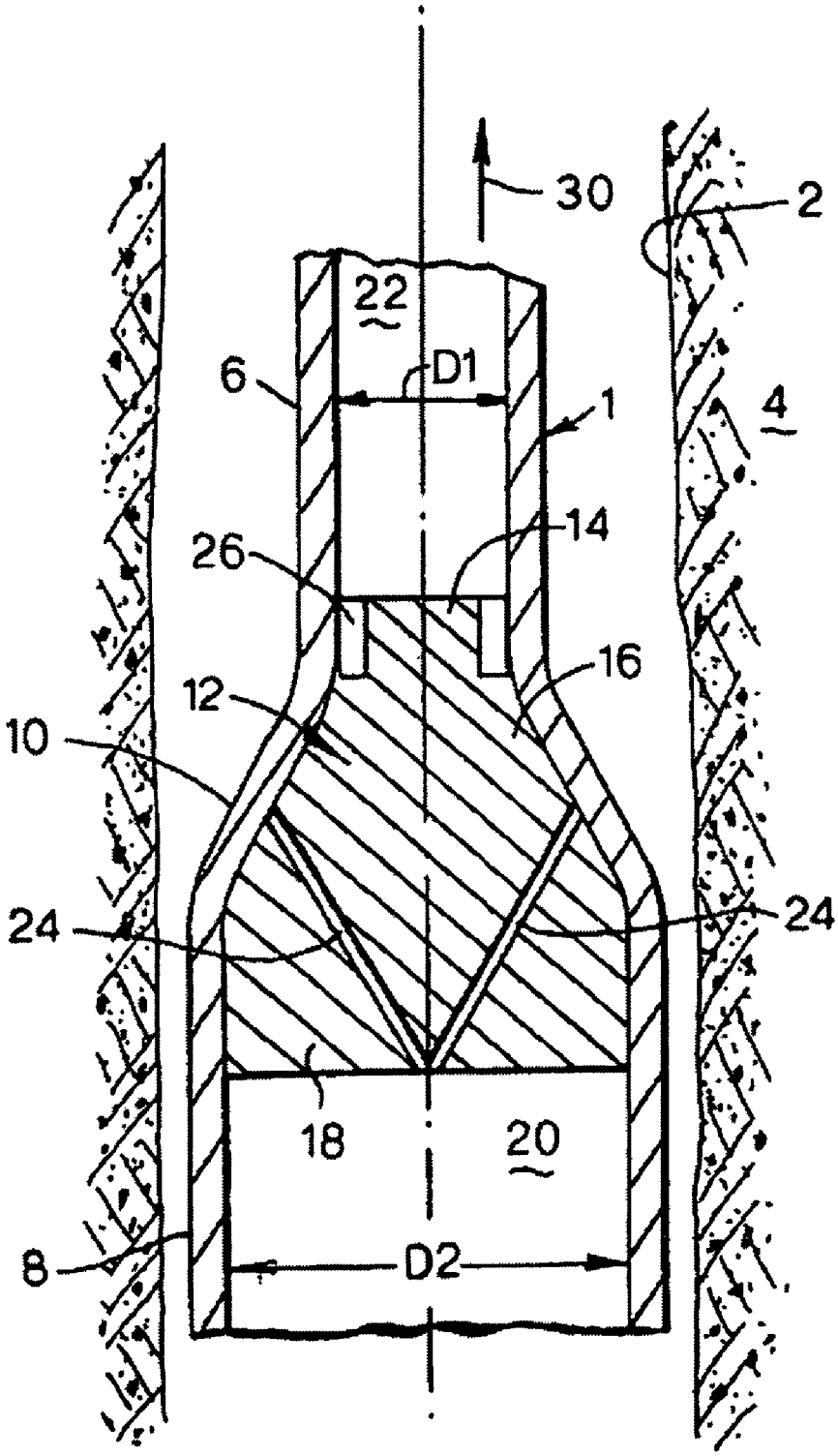
FIG. 1 schematically shows a longitudinal section of an embodiment of an expander according to the invention.

In FIG. 1 is shown a tubular element in the form of a steel casing 1 extending into a wellbore 2 drilled into an earth formation 4. The casing 1 has an unexpanded section 6 of inner diameter D1, a radially expanded section 8 of inner diameter D2 larger than D1, and an intermediate section 10 located between the unexpanded section 6 and the expanded section 10 and having a diameter varying from D1 to D2.

A cone-shaped expander 12 is positioned in the casing 1, the expander having a front part 14 arranged in the unexpanded casing section 6, an intermediate part 16 arranged in the intermediate casing section 10 and a rear part 18 arranged in the expanded casing section 8. The outer diameter of the front part 14 is substantially equal to D1, and the outer diameter of the rear part is substantially equal to D2 minus any surplus expansion of the casing 1 (which can be up to 3%).

The expanded casing section 8 is filled with a body of wellbore fluid 20, and the unexpanded casing section 6 is filled with a body of wellbore fluid 22, whereby the fluid pressure in the body of fluid 20 is significantly larger than the fluid pressure in the body of wellbore fluid 22.

The expander 12 is provided with a number of fluid passages 24 which provide fluid communication between the body of fluid 20 and the inner surface of the intermediate casing section 10 opposite the intermediate part 16, at regular circumferential intervals. Furthermore, the front part 14 of the expander 12 is provided with an annular seal 26 of ceramic material and of outer diameter substantially equal to D1. The seal 26 substantially prevents leakage of fluid from the high pressure body of fluid 20 to the low pressure body of fluid 22.

Figure 2:
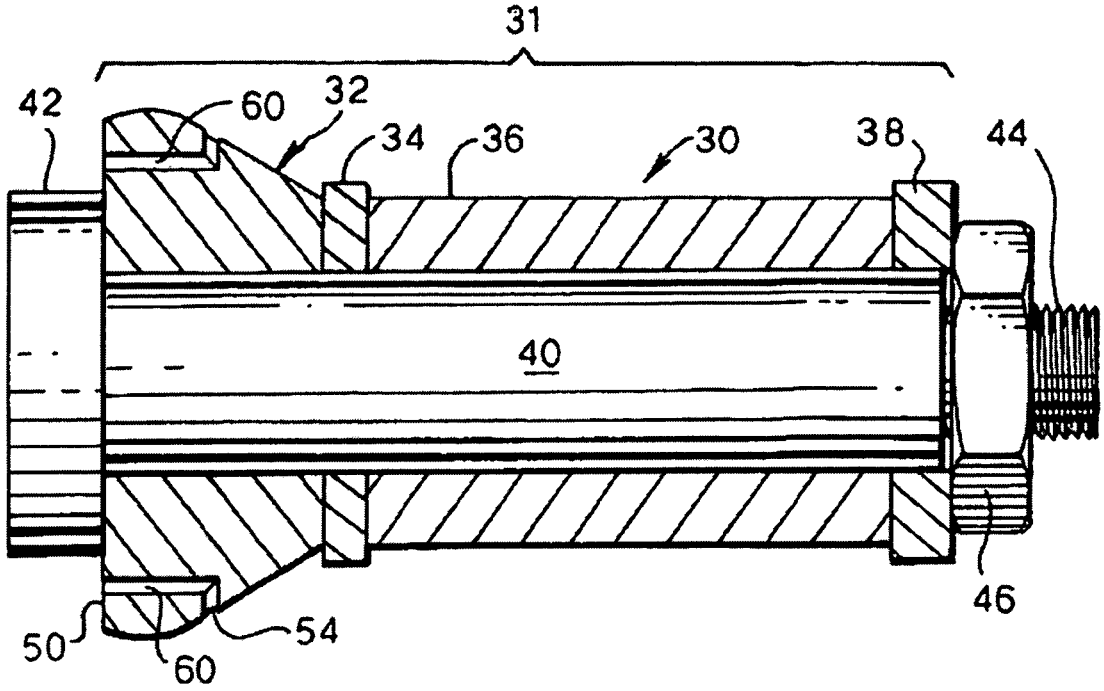
FIG. 2 schematically shows a longitudinal section of an alternative embodiment of an expander according to the invention.

Referring to FIG. 2 there is shown a longitudinal section of an alternative expander 30 for expanding the casing 1, which includes an annular assembly 31 consisting of, in subsequent order, a cone member 32, a centraliser 34, a spacer bushing 36 and an annular seal 38. The annular assembly 31 is held together by a shank 40 having a head 42 at one end thereof and a threaded end portion 44 provided with a nut 46 at the other end thereof. The outer diameter of the annular seal 38 and the centraliser 34 is about equal to the inner diameter of the casing 1 before expansion thereof.

Figure 3:
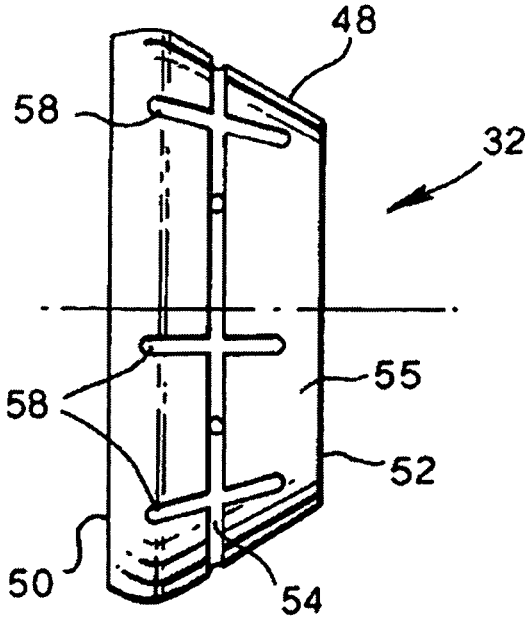
FIG. 3 schematically shows a side view of a cone member of the alternative embodiment.

Referring further to FIG. 3, the cone member 32 is formed of a body 48 tapering from a large diameter end 50 to a small diameter end 52 and provided with a circumferential groove 54 arranged in the tapered surface 55 of the body 48 at an axial position about midway the large diameter end 50 and the small diameter end 52. The body 48 is furthermore provided with a number of regularly spaced axial grooves 58 arranged in the tapered surface 55, whereby each axial groove 58 crosses the circumferential groove 54. A number of fluid passages 60 are provided in the body 48 so as to provide fluid communication between the large diameter end 50 of the body 48 and the circumferential groove 54.

During normal operation of the expander 12 shown in FIG. 1, the casing 1 is lowered in unexpanded state into the wellbore 2 whereafter the expander 12 is inserted into the casing 1 at an end thereof, which can be either the upper end or the lower end. Subsequently a relatively high fluid pressure is applied to the body of fluid 20. As a result the expander is forced to moved in the direction of arrow 30 thereby exerting a radially outward contact force to the inner surface of the intermediate casing section 10. Said contact force is supplemented by the high fluid pressure which is transmitted from the body of fluid 20 through the passages 22 to the inner surface of the intermediate casing section 10. The casing 1 is thereby expanded from inner diameter D1 to inner diameter D2. Leakage of fluid from the body of fluid 20 along the expander 12 to the body of fluid 22 is substantially prevented by the seal 26.

It was found that the required fluid pressure in body of fluid 20 necessary to move the expander 12 through the casing 1 is significantly reduced compared to the situation whereby the expander is not provided with the fluid passages 24. It is believed that this result is due to the contact force from the expander 12 being supplementing by the high fluid pressure acting against the inner surface of the intermediate casing section 1, and also the lubricating effect of the fluid between the expander 12 and the casing 1.

Normal operation of the expander 30 of FIGS. 2 and 3 is substantially similar to normal operation of the expander of FIG. 1. The expander is moved through the casing 1 by high fluid pressure applied to the expander 30 at the side of the large diameter end 50. The radially outward contact force exerted to the inner surface of the casing 1 by the cone member 32 is supplemented by the high fluid pressure which is transmitted from the large diameter end 50 to the inner surface of the casing 1 via the fluid passages 60, circumferential groove 54 and axial grooves 58. The annular seal 38 substantially prevents leakage of fluid along the expander 30.

Figure 4:
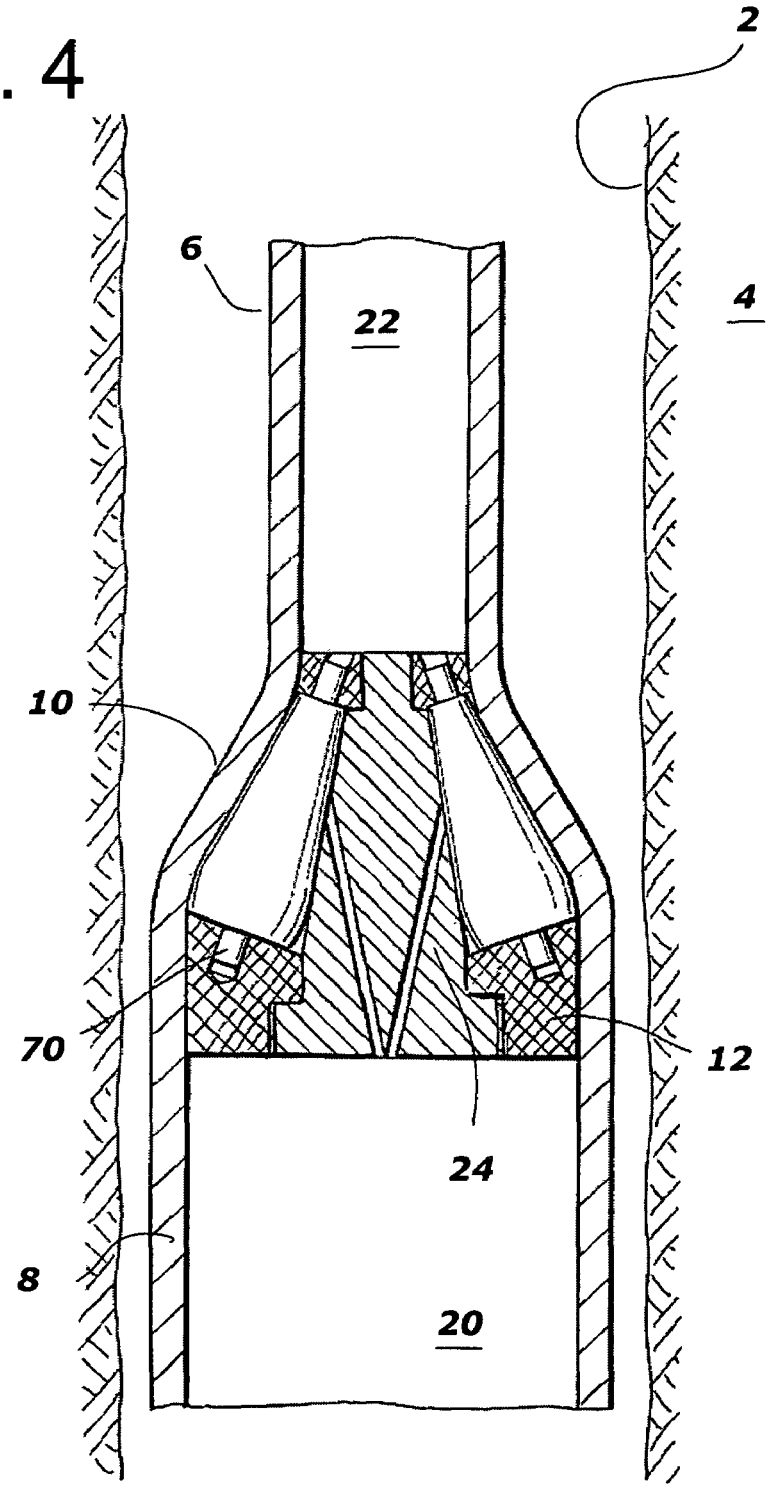
FIG. 4 schematically shows a longitudinal section of an alternative embodiment of an expander according to the invention.

Referring to FIG. 4, there is shown a longitudinal section of an alternative embodiment of an expander 12 in wellbore 2. In this embodiment, the expander 12 is provided with rollers 70 arranged to roll along the inner surface of the tubular element (unexpanded casing section 6, expanded casing section 8, or intermediate section 10) during expansion. Many of the same features from FIG. 1 are shown.

It is to be noted that, in general, the cone member will be in tight contact with the tubular element at two annular contact areas, one near the small diameter end of the cone member and the other near the large diameter end of the cone member. Optimally, the arrangement of the fluid passages should be such that the high fluid pressure is delivered to the inner surface of the tubular element at an axial position inbetween such annular contact areas. Since there will be a tight contact between the cone member and the tubular element at the annular contact areas, the annular contact areas act as seals whereby the contact area near the small diameter end prevents leakage of fluid along the expander. The annular seal at the front end of the expander can therefore optionally be omitted. This is also applicable to cone-shaped expanders in a more general sense.

In some applications it can be advantageous to apply an expander member in the form of an expandable cone which can be inserted into the tubular element at a relatively small diameter, and thereafter be expanded to a larger diameter when expansion of the tubular element starts. Since such expandable cone, generally, has separate parts which are movable relative to each other, it is difficult to pump the expandable cone through the tubular element in view of leakage of fluid along such separate parts. By arranging sealing means at the front end part of the expandable cone it is achieved a) that the leakage problem has been overcome and b) that the radially outward contact force between the expander and the inner surface of the tubular element is supplemented by the high fluid pressure acting on said inner surface. In such application, the fluid supply means is simply formed by the clearances between the separate parts of the expander member.

Furthermore, the application of a seal at the front part of the expander member allows the application of one or more rollers at the expander member, arranged to roll along the inner surface of the tubular member during the expansion process, in combination with pumping of the expander through the tubular element.

We claim:

1. An expander for radially expanding a tubular element by axial movement of the expander through the tubular element, the expander comprising an expander member having a front part of a first cross-sectional size, a rear part of a second cross-sectional size larger than the first cross-sectional size, and an intermediate part arranged between said front part and rear part and having a cross-sectional size varying between said first and second cross-sectional sizes, wherein the expander member is provided with fluid supply means for supplying pressurized fluid to the inner surface of the tubular element at a location opposite said intermediate part when the expander member is arranged in the tubular element.

2. The expander of claim 1, wherein the expander is arranged to be moved through the tubular element by the action of fluid pressure of a body of fluid acting on the expander member, and wherein the fluid supply means includes a fluid passage providing fluid communication between said body of fluid and the inner surface of the tubular element at said location.

3. The expander of claim 1, wherein said front part of the expander member is provided with sealing means arranged to seal the front part relative to the inner surface of the tubular element.

4. The expander of claim 3, wherein the expander member includes different elements movable relative to each other between a retracted position in which said rear part has a cross-sectional size smaller than said second cross-sectional size and an expanded position in which the rear part has said second cross-sectional size.

5. The expander of claim 3, wherein the sealing means includes an annular seal of outer diameter substantially equal to the inner diameter of the tubular element before expansion thereof.

6. The expander of claim 3, wherein the sealing means is one of a group consisting of ceramic seal, a labyrinth seal and a hard metal seal.

7. The expander of claim 1, wherein the expander member is cone-shaped.

8. The expander of claim 1, wherein the expander member is provided with rollers arranged to roll along the inner surface of the tubular element during expansion thereof.

9. The expander of claim 1, wherein the tubular element is one of a wellbore tube and a surface pipe.

10. A method of radially expanding a tubular element, comprising a) moving an expander in axial direction through the tubular element, the expander including an expander member having a front part of a first cross-sectional size, a rear part of a second cross-sectional size larger than the first cross-sectional size, and an intermediate part arranged between said front part and rear part and having a cross-sectional size varying between said first and second cross-sectional sizes; and b) simultaneously with step a), supplying pressurized fluid to the inner surface of the tubular element at a location opposite said intermediate part.

11. The method of claim 10, wherein in step a) the expander is moved through the tubular element by the action of fluid pressure of a body of fluid acting on the expander member, and wherein in step b) said pressurized fluid is supplied to the inner surface of the tubular element via a fluid passage formed in the expander member, said fluid passage providing fluid communication between said body of fluid and said inner surface of the tubular element.

12. The expander of claim 2, wherein said front part of the expander member is provided with sealing means arranged to seal the front part relative to the inner surface of the tubular element.

13. The expander of claim 4, wherein the sealing means includes an annular seal of outer diameter substantially equal to the inner diameter of the tubular element before expansion thereof.

14. The expander of claim 4, wherein the sealing means is one of a group consisting of ceramic seal, a labyrinth seal and a hard metal seal.

15. The expander of claim 5, wherein the sealing means is one of a group consisting of ceramic seal, a labyrinth seal and a hard metal seal.

* * * * *